US007815294B2

(12) United States Patent
Kojima et al.

(10) Patent No.: US 7,815,294 B2
(45) Date of Patent: Oct. 19, 2010

(54) LIQUID EJECTION HEAD, IMAGE FORMING APPARATUS AND METHOD OF MANUFACTURING LIQUID EJECTION HEAD

(75) Inventors: Toshiya Kojima, Kanagawa (JP); Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 475 days.

(21) Appl. No.: 11/376,150

(22) Filed: Mar. 16, 2006

(65) Prior Publication Data

US 2006/0209137 A1 Sep. 21, 2006

(30) Foreign Application Priority Data

Mar. 17, 2005 (JP) ..... 2005-077712

(51) Int. Cl.
*B41J 2/045* (2006.01)
*B41J 2/14* (2006.01)

(52) U.S. Cl. ..... 347/71; 347/50; 347/68

(58) Field of Classification Search ..... 347/68–72, 347/58, 50

See application file for complete search history.

(56) References Cited

U.S. PATENT DOCUMENTS 5,940,099 A 8/1999 Karlinski
6,270,193 B1 * 8/2001 Hiwada ..... 347/50
6,276,781 B1 * 8/2001 Hasegawa ..... 347/50
6,439,702 B1 8/2002 Karlinski
6,481,074 B1 11/2002 Karlinski
6,488,355 B2 12/2002 Nakamura et al.
6,491,384 B2 * 12/2002 Usui et al. ..... 347/70
6,616,270 B1 * 9/2003 Miyata et al. ..... 347/68
6,766,567 B2 7/2004 Karlinski
6,808,254 B2 10/2004 Sakaida et al.
7,628,470 B2 * 12/2009 Mita ..... 347/58
2003/0103118 A1 6/2003 Watanabe et al.

(Continued)

FOREIGN PATENT DOCUMENTS

JP 9-226114 A 9/1997

(Continued)

*Primary Examiner*—Stephen D Meier
*Assistant Examiner*—Geoffrey Mruk
(74) *Attorney, Agent, or Firm*—Birch, Stewart, Kolasch and Birch, LLP

(57) ABSTRACT

The liquid ejection head includes: a plurality of ejection ports which eject liquid; a plurality of pressure chambers which are respectively connected to the ejection ports; a plurality of piezoelectric elements which respectively deform the pressure chambers, the piezoelectric elements being arranged on sides of the pressure chambers opposite to sides thereof where the ejection ports are formed; a common liquid chamber which supplies the liquid to the pressure chambers, the common liquid chamber being arranged on the sides of the pressure chambers opposite to the sides thereof where the ejection ports are formed; a plurality of wiring members which have electrodes for driving the piezoelectric elements, respectively, each of the wiring members being formed in such a manner that at least a portion thereof rises through the common liquid chamber in a direction substantially perpendicular to a plane on which the piezoelectric elements are arranged; and a drive circuit which drives the piezoelectric elements, the drive circuit being arranged on a wall of the common liquid chamber opposite to a side thereof where the piezoelectric elements are arranged, wherein the electrodes and the drive circuit are composed and covered integrally with resin.

7 Claims, 9 Drawing Sheets

U.S. PATENT DOCUMENTS

| | | | |
|---|---|---|---|
| 2003/0122902 | A1 | 7/2003 | Sakaida et al. |
| 2003/0156164 | A1 | 8/2003 | Sakaida et al. |
| 2003/0206218 | A1 | 11/2003 | Miyata et al. |
| 2004/0041885 | A1 | 3/2004 | Hirota |
| 2004/0090498 | A1 | 5/2004 | Sakaida et al. |
| 2005/0231554 | A1 | 10/2005 | Sakaida et al. |

FOREIGN PATENT DOCUMENTS

| | | | |
|---|---|---|---|
| JP | 2000-127379 | A | 5/2000 |
| JP | 2000-289201 | A | 10/2000 |
| JP | 2001-179973 | A | 7/2001 |
| JP | 2001-334661 | A | 12/2001 |
| JP | 2002-166543 | A | 6/2002 |
| JP | 2003-512211 | A | 4/2003 |
| WO | WO-01/30577 | A1 | 5/2001 |

* cited by examiner

LIQUID EJECTION HEAD, IMAGE FORMING APPARATUS AND METHOD OF MANUFACTURING LIQUID EJECTION HEAD

BACKGROUND OF THE INVENTION

1. Field of the Invention

The present invention relates to a liquid ejection head, an image forming apparatus, and a method of manufacturing a liquid ejection head, and more particularly, to technology for disposing the driving wires of piezoelectric elements provided in a liquid ejection head.

2. Description of the Related Art

There are inkjet type image forming apparatuses comprising print heads (liquid ejection heads) in which nozzles are arranged in a matrix array (see, for example, Japanese Patent Application Publication Nos. 2001-334661 and 2002-166543). The print heads disclosed in Japanese Patent Application Publication Nos. 2001-334661 and 2002-166543 have a common liquid chamber formed on the same side of the pressure chambers as the side on which the nozzles are formed. In these print heads, if drive wires for driving the piezoelectric elements are disposed on the diaphragm, there is a probability that insufficient space is available for laying the drive wires, and high density arrangement of the nozzles becomes difficult. Furthermore, due to restrictions on the size of the common liquid chamber and the complexity of the flow channels between the common liquid chamber and the pressure chambers, the resulting structure makes it difficult to improve refilling performance.

Therefore, various compositions that are different to the aforementioned print heads have been proposed (see, for example, Japanese Patent Application Publication Nos. 9-226114, 2001-179973, 2000-127379, 2003-512211 and 2000-289201). Japanese Patent Application Publication Nos. 9-226114, 2001-179973, 2000-127379 and 2003-512211 disclose compositions where a common liquid chamber and piezoelectric elements are disposed on the opposite side of the pressure chambers from the side on which the nozzles are formed, and Japanese Patent Application Publication No. 2000-289201 discloses a composition where a common liquid chamber and piezoelectric elements are disposed on the same side of the pressure chambers as the side on which the nozzles are formed. The specific composition of each of these print heads is as described below.

Japanese Patent Application Publication No. 9-226114 discloses a composition in which ink supply channels for supplying ink to the pressure chambers are provided on a diaphragm forming the upper surface of the pressure chambers, and a reservoir (common liquid chamber) is formed on the surface of the diaphragm reverse to the surface adjacent to the pressure chambers, in such a manner that ink is supplied from the reservoir to the pressure chambers, through the ink supply channels. However, in this print head, if the drive wires of the piezoelectric elements are arranged on the diaphragm, then as the number of piezoelectric elements on the diaphragm rises with increase in the number of nozzles, there is a probability that insufficient wiring space is available for the drive wires.

Japanese Patent Application Publication No. 2001-179973 discloses a composition in which supply restrictors are provided in a diaphragm, an ink supply tank forming an ink supply unit is provided on the opposite side of the piezoelectric elements from the pressure chambers, and ink supply ports connecting to the pressure chambers are formed passing through the diaphragm, from the ink supply tank. A hermetic sealing cover for ensuring the insulating properties of the piezoelectric elements, and a thin section for absorbing pressure variations in the pressure chambers are formed in the ink supply unit. However, this print head adopts a composition in which a flexible cable is connected to an extending section of the diaphragm, and therefore, the drive wires of the piezoelectric elements must be disposed on the diaphragm, and similarly to Japanese Patent Application Publication No. 9-226114, there is a probability that insufficient wiring space is available for the drive wires.

Japanese Patent Application Publication No. 2000-127379 discloses a composition in which piezoelectric elements are provided on the surfaces of the pressure chambers opposite to the surfaces on which nozzles are provided, a portion of a reservoir for supplying ink is provided on the side adjacent to the piezoelectric elements, and a covering is provided on the piezoelectric elements, in such a manner that electrodes can be extracted by wire bonding, thin film formation, or the like. However, in this print head, the nozzle arrangement has one nozzle row rather than a matrix structure, and is therefore unsuitable for achieving high nozzle density.

Japanese Patent Application Publication No. 2003-512211 discloses a composition in which a porous member having a large number of small, internally connected pores, such as sintered stainless steel, is used as an ink supply layer. However, in this print head, the drive wires of the piezoelectric elements are formed so as to rise up in a direction substantially perpendicular to the diaphragm, until reaching a wiring layer, and a common liquid chamber is provided on top of the wiring layer. Therefore, the flow channel for supplying ink from the common liquid chamber to the pressure chambers is long, and furthermore, since the ink supply layer is constituted by a porous member, the flow channel resistance is high and refilling performance is not satisfactory. Consequently, it is difficult to eject ink of high viscosity or to drive nozzles at a high frequency.

Japanese Patent Application Publication No. 2000-289201 discloses a print head having a composition in which a common liquid chamber and piezoelectric elements are disposed on the same side of the pressure chambers as the side on which the nozzles are formed, the piezoelectric elements disposed on the nozzle surface side of the pressure chambers, and the drive circuit disposed on the opposite side from same being electrically connected by means of aluminum plugs which pass through the laminated layers. However, in this print head, a common liquid chamber is disposed on the same side of the pressure chambers as the side where the nozzles are formed, and hence this composition places restrictions on the size of the common liquid chamber as in the case of the print head disclosed in Japanese Patent Application Publication Nos. 2001-334661 and 2002-166543, and makes it difficult to improve refilling performance. Moreover, while the piezoelectric elements are disposed on the same side of the pressure chambers as the side where the nozzles are formed, the drive circuit for the piezoelectric elements is positioned on the opposite side of the pressure chambers from the side where the nozzles are formed, and therefore the drive wires for the piezoelectric elements must be provided so as to pass through the laminated plates which constitute the pressure chambers. Consequently, if the number of pressure chambers rises with increase in the density of the nozzles, then there is a probability that insufficient wiring space is available for the drive wires.

In print heads in the related art as described above, it is difficult to ensure wiring space for the drive wires, or to improve refilling performance, and it is difficult to achieve high-density arrangement of the nozzles or ejection of high-viscosity ink. Furthermore, since the number of drive wires rises as the nozzle density is increased, then it becomes necessary not only to ensure sufficient wiring space for the drive wires, but also to improve the productivity of the constituent members, including the drive wires. Moreover, depending on the arrangement of the drive wires, it may also be required to provide reliable insulation processing for the drive wires.

SUMMARY OF THE INVENTION

The present invention has been contrived in view of the foregoing circumstances, and provides a liquid ejection head, an image forming apparatus and a method of manufacturing a liquid ejection head, whereby high-density arrangement of nozzles and ejection of high-viscosity ink can be achieved, as well as improving the productivity of the constituent members including the drive wires, and enabling reliable insulation processing of the drive wires.

In order to attain the aforementioned object, the present invention is directed to a liquid ejection head, comprising: a plurality of ejection ports which eject liquid; a plurality of pressure chambers which are respectively connected to the ejection ports; a plurality of piezoelectric elements which respectively deform the pressure chambers, the piezoelectric elements being arranged on sides of the pressure chambers opposite to sides thereof where the ejection ports are formed; a common liquid chamber which supplies the liquid to the pressure chambers, the common liquid chamber being arranged on the sides of the pressure chambers opposite to the sides thereof where the ejection ports are formed; a plurality of wiring members which have electrodes for driving the piezoelectric elements, respectively, each of the wiring members being formed in such a manner that at least a portion thereof rises through the common liquid chamber in a direction substantially perpendicular to a plane on which the piezoelectric elements are arranged; and a drive circuit which drives the piezoelectric elements, the drive circuit being arranged on a wall of the common liquid chamber opposite to a side thereof where the piezoelectric elements are arranged, wherein the electrodes and the drive circuit are composed and covered integrally with resin.

According to the present invention, by providing the common liquid chamber on the opposite side of the pressure chambers to the side where the ejection ports (nozzles) are formed, and by providing the wiring members having the electrodes for driving the piezoelectric elements in such a manner that the wiring members rise through the common liquid chamber, it is possible to ensure sufficient wiring space for the driving wires in the wall of the common liquid chamber on the opposite side to the side where the piezoelectric elements are formed, and furthermore, refilling performance is improved. Consequently, high-density arrangement of the nozzles can be achieved and high-viscosity ink can be ejected. In particular, in the present invention, by integrally forming the driving circuits and the electrodes of the wiring members, in such a manner that they are covered with the resin, it is possible to ensure reliable insulation processing of the electrodes, as well as improving the productivity of the liquid ejection head. Furthermore, a high level of integration can be achieved in the liquid ejection head, thereby making it possible to reduce the size of the liquid ejection head.

Preferably, the wiring members are formed so as to rise from the piezoelectric elements. Alternatively, it is also preferable that the wiring members are formed so as to rise from vicinity of the piezoelectric elements.

According to these aspects of the present invention, the density of the ejection ports (nozzles) can be increased.

Preferably, the ejection ports are arranged in a two-dimensional array; and the wiring members are arranged two-dimensionally on the plane where the piezoelectric elements are arranged.

According to this aspect of the present invention, it is possible to achieve an even higher density of the ejection ports (nozzles), and furthermore, space for positioning the wire members is ensured and the flow resistance inside the common liquid chamber is reduced.

In order to attain the aforementioned object, the present invention is also directed to an image forming apparatus, comprising the above-described liquid ejection head.

In order to attain the aforementioned object, the present invention is also directed to a method of manufacturing a liquid ejection head comprising: a plurality of ejection ports which eject liquid; a plurality of pressure chambers which are respectively connected to the ejection ports; a plurality of piezoelectric elements which respectively deform the pressure chambers, the piezoelectric elements being arranged on sides of the pressure chambers opposite to sides thereof where the ejection ports are formed; a common liquid chamber which supplies the liquid to the pressure chambers, the common liquid chamber being arranged on the sides of the pressure chambers opposite to the sides thereof where the ejection ports are formed; a plurality of wiring members which have electrodes for driving the piezoelectric elements, respectively, each of the wiring members being formed in such a manner that at least a portion thereof rises through the common liquid chamber in a direction substantially perpendicular to a plane on which the piezoelectric elements are arranged; and a drive circuit which drives the piezoelectric elements, the drive circuit being arranged on a wall of the common liquid chamber opposite to a side thereof where the piezoelectric elements are arranged, the method comprising the steps of: forming a plurality of projecting conducting members corresponding to the electrodes, on a metal layer corresponding to a portion of the wall of the common liquid chamber opposite to the side thereof where the piezoelectric elements are arranged; performing a first resin molding of molding resin over a surface of the metal layer on the side where the conducting members are formed, thereby covering side faces of the conducting members with the resin; electrically separating the conducting members from each other by processing the metal layer; installing the drive circuit at a prescribed position of the metal layer; electrically connecting the drive circuit to the conducting members having been electrically separated from each other; and performing a second resin molding of molding resin over a surface of the metal layer reverse to the surface thereof on which the conducting members are formed, thereby covering the surface of the metal layer and a surface of the drive circuit with the resin.

In order to attain the aforementioned object, the present invention is also directed to a method of manufacturing a liquid ejection head comprising: a plurality of ejection ports which eject liquid; a plurality of pressure chambers which are respectively connected to the ejection ports; a plurality of piezoelectric elements which respectively deform the pressure chambers, the piezoelectric elements being arranged on sides of the pressure chambers opposite to sides thereof where the ejection ports are formed; a common liquid chamber which supplies the liquid to the pressure chambers, the common liquid chamber being arranged on the sides of the pressure chambers opposite to the sides thereof where the ejection ports are formed; a plurality of wiring members which have electrodes for driving the piezoelectric elements, respectively, each of the wiring members being formed in such a manner that at least a portion thereof rises through the common liquid chamber in a direction substantially perpendicular to a plane on which the piezoelectric elements are arranged; and a drive circuit which drives the piezoelectric elements, the drive circuit being arranged on a wall of the common liquid chamber opposite to a side thereof where the piezoelectric elements are arranged, the method comprising the steps of: installing the drive circuit at a prescribed position on a metal layer corresponding to a portion of the wall of the common liquid chamber opposite to the side thereof where the piezoelectric elements are arranged, the metal layer being formed with a prescribed wiring pattern; forming a plurality of projecting conducting members corresponding to the electrodes, on the metal layer; and molding resin over both surfaces of the metal layer, thereby covering the surfaces of the metal layer, a surface of the drive circuit and side faces of the conducting members, with the resin.

According to the present invention, by providing a common liquid chamber on the opposite side of the pressure chambers to the side where the ejection ports (nozzles) are formed, and by providing the wiring members having the electrodes for driving the piezoelectric elements in such a manner that the wiring members rise through the common liquid chamber, it is possible to ensure sufficient wiring space for the driving wires in the wall of the common liquid chamber on the opposite side to the side where the piezoelectric elements are formed, and furthermore, refilling performance is improved. Consequently, high-density arrangement of the nozzles can be achieved and high-viscosity ink can be ejected. In particular, in the present invention, by forming the electrodes of the wiring members, and the driving circuits in an integrated fashion, in such a manner that they are covered with resin, it is possible to ensure reliable insulation processing of the electrodes, as well as improving the productivity of the liquid ejection head. Furthermore, a high level of integration can be achieved in the liquid ejection head, thereby making it possible to reduce the size of the liquid ejection head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
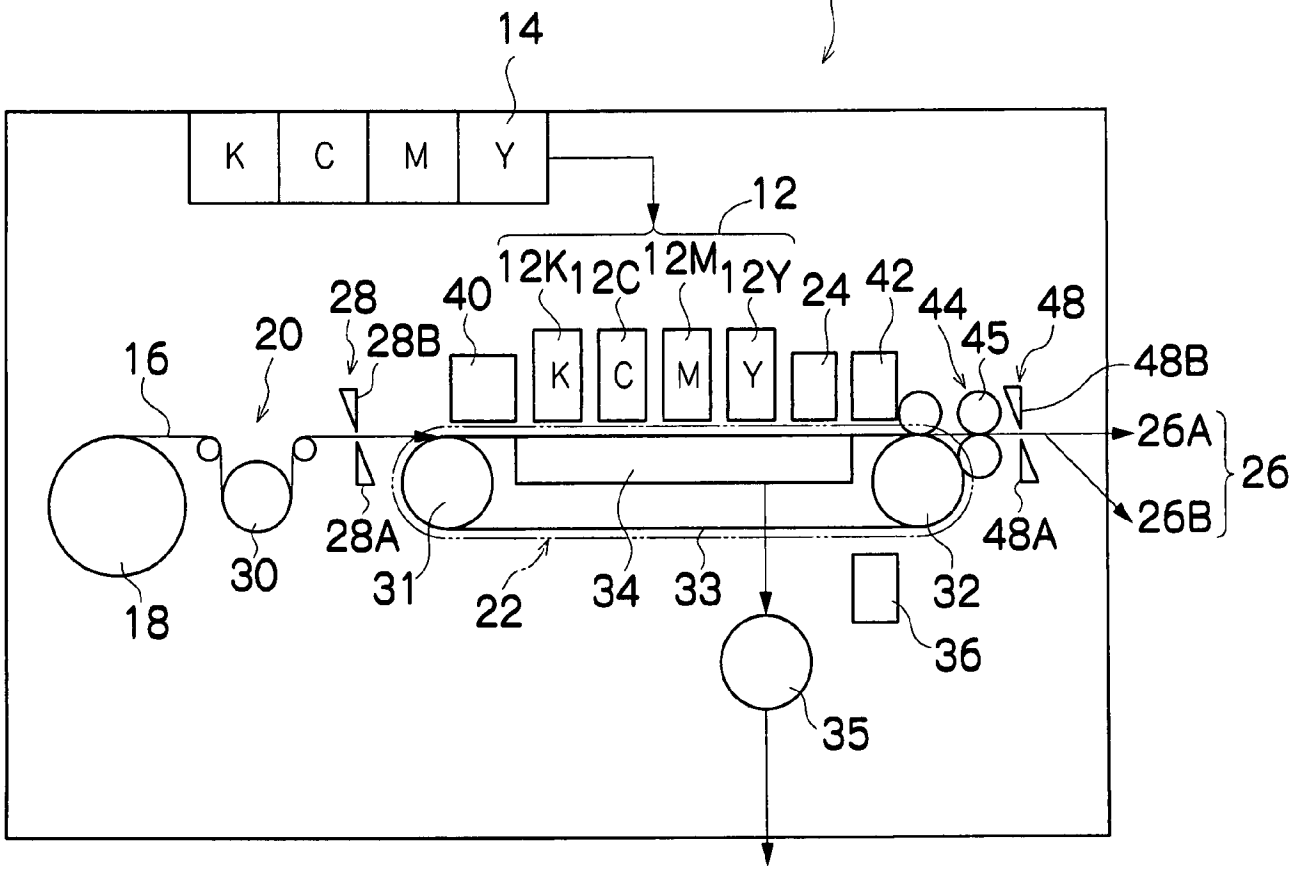
FIG. 1 is a general schematic drawing of an inkjet recording apparatus according to a first embodiment of the present invention.

FIG. 1 is a general schematic drawing of an inkjet recording apparatus forming one embodiment of an image forming apparatus to which the present invention is applied. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub scanning direction).

More specifically, the print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in a direction (main scanning direction) that is perpendicular to the paper conveyance direction.

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the KMCY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 2:
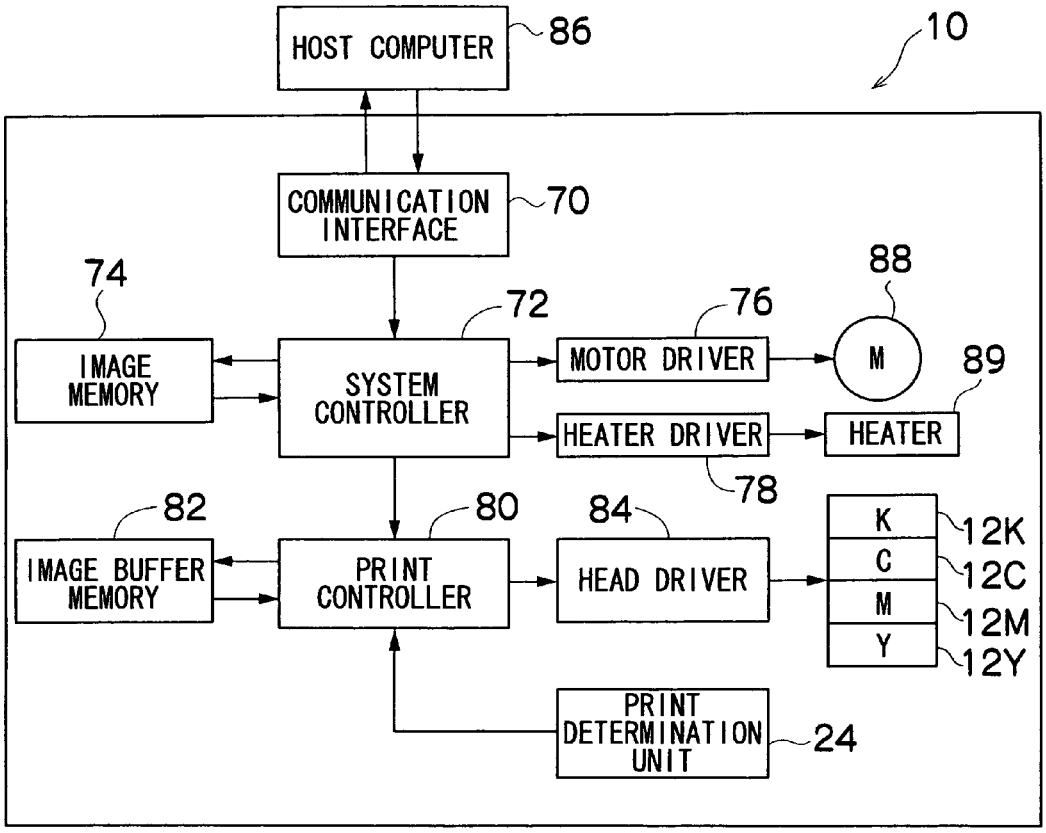
FIG. 2 is a principal block diagram showing the system composition of the inkjet recording apparatus.

FIG. 2 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE 1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 12K, 12C, 12M and 12Y are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 2 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives piezoelectric elements 58 (not shown in FIG. 2, but shown in FIG. 4) of the print heads of the respective colors 12K, 12C, 12M and 12Y on the basis of print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

The print controller 80 makes various corrections with respect to the print heads 12K, 12C, 12M and 12Y on the basis of information obtained from the print determination unit 24.

Figure 3:
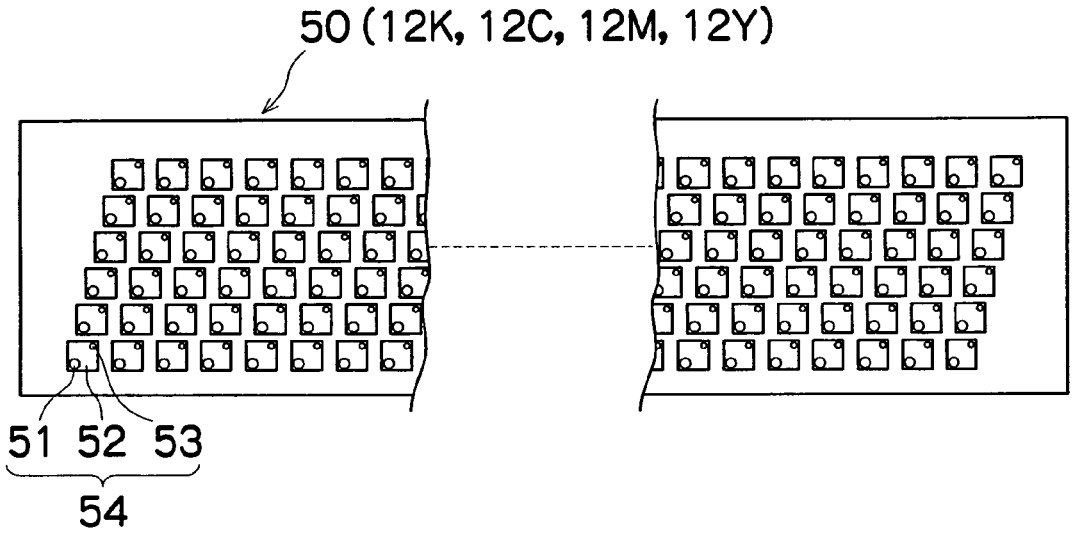
FIG. 3 is a plan perspective diagram showing an embodiment of the structure of a print head.

Next, the structure of the print heads 12K, 12C, 12M and 12Y is described. FIG. 3 is a plan view perspective diagram showing the embodiment of the structure of the print head. In FIG. 3, in order to aid understanding of the basic composition of the print head, the piezoelectric elements, wiring members, and the like, described later are omitted from the drawings. The print heads 12K, 12C, 12M and 12Y provided for the respective ink colors have the same structure, and a representative print head is hereinafter designated by the reference numeral 50.

As shown in FIG. 3, the print head 50 has a structure in which a plurality of pressure chamber units 54, each comprising a nozzle 51 for ejecting ink droplets, a pressure chamber 52 corresponding to the nozzle 51, and an ink supply port 53, are arranged in a staggered matrix configuration. The pressure chambers 52 each have a substantially square planar shape, and the nozzle 51 and the ink supply port 53 are provided at respective comers on a diagonal line of this shape. By adopting a matrix structure of this kind, the nozzle pitch can be reduced and the pitch of the dots printed on the recording medium can be also reduced.

Figure 4:
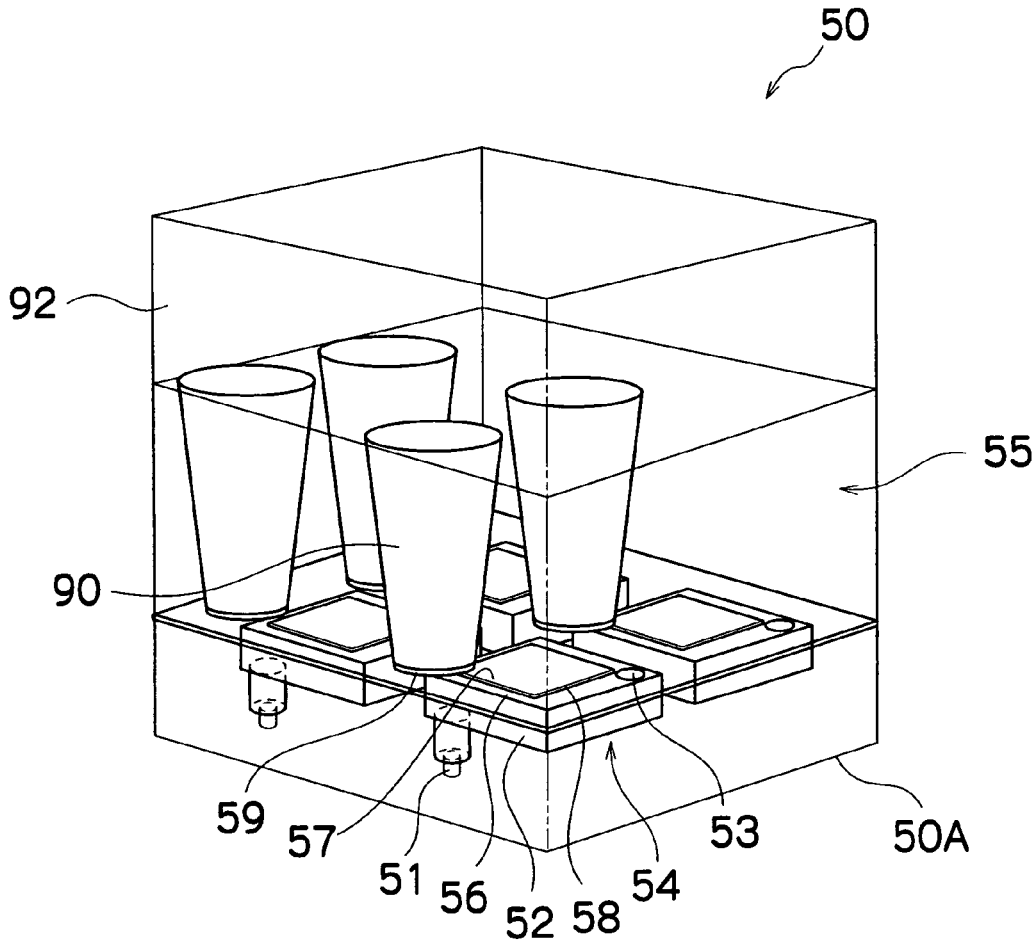
FIG. 4 is an oblique perspective diagram showing a portion of the approximate internal composition of the print head.

FIG. 4 is an oblique perspective diagram showing a portion of the approximate internal composition of the print head 50. FIG. 4 shows a composition which includes four pressure chamber units 54. The nozzles 51 are formed on the nozzle surface 50A, and the pressure chambers 52 having a substantially rectangular parallelepiped shape are connected to the nozzles 51. The surface on the side of the pressure chambers 52 opposite to the side where the nozzles 51 are formed is constituted by a diaphragm 56. The piezoelectric elements 58 are provided on the diaphragm 56 at positions corresponding to the respective pressure chambers 52.

The space created above the piezoelectric elements 58 is a common liquid chamber 55, which accumulates ink to be supplied to the respective pressure chambers 52. The common liquid chamber 55 is connected to the pressure chambers 52 through the ink supply ports 53 provided respectively for the pressure chambers 52, and the ink accumulated in the common liquid chamber 55 is distributed and supplied to the pressure chambers 52.

Tapered column-shaped wiring members 90, which become thinner from the upper side to the lower side in FIG. 4, are provided in the common liquid chamber 55. More specifically, the wiring members 90 are formed so as to rise upward through the common liquid chamber 55 in a direction substantially perpendicular to the diaphragm 56 forming the surface on which the piezoelectric elements 58 are disposed. The wiring members 90 are provided corresponding to the respective piezoelectric elements 58, and each of the wiring members 90 contains an electrode 92 (not shown in FIG. 4, but shown in FIG. 6) provided inside same. The upper side of each wiring member 90 is connected to a wiring substrate 96, which constitutes the upper wall of the common liquid chamber 55.

Figure 5:
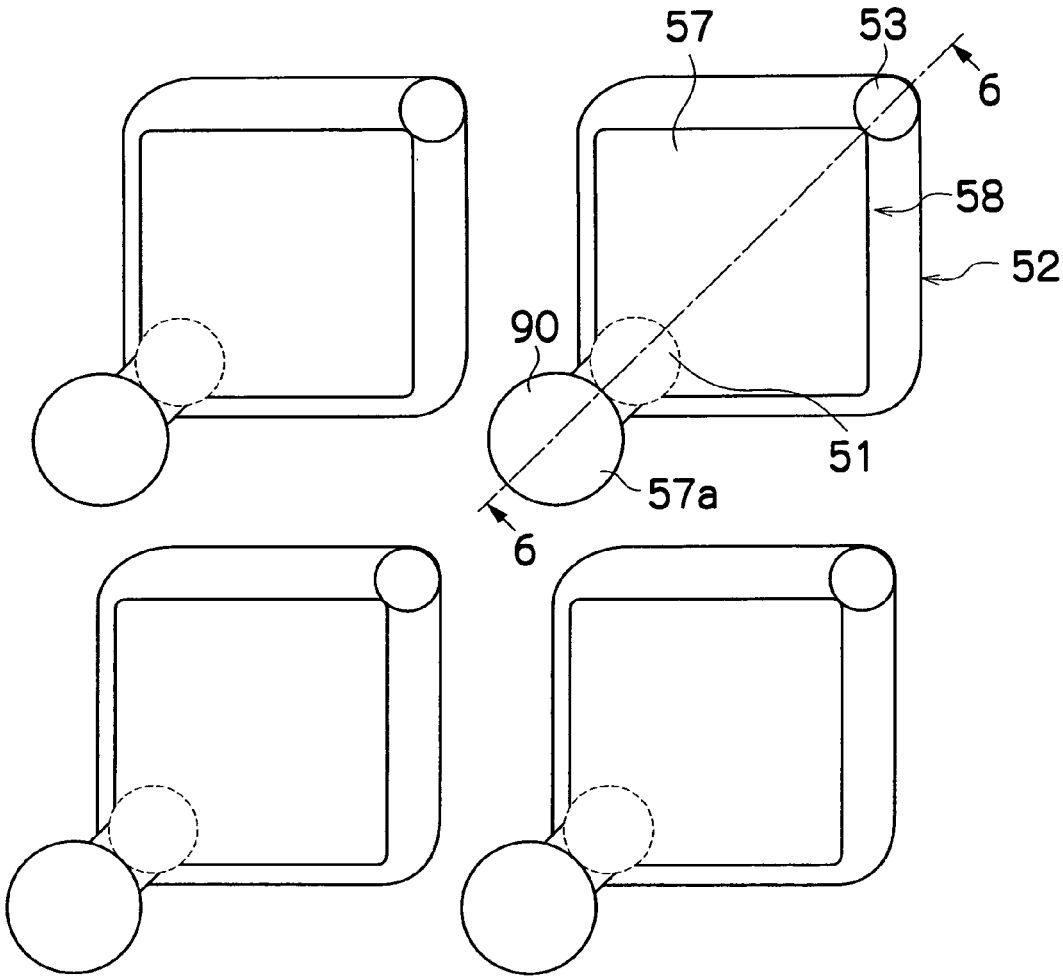
FIG. 5 is an illustrative diagram showing the planar arrangement of piezoelectric elements and wiring members.

FIG. 5 is an illustrative diagram showing the planar arrangement of the piezoelectric elements 58 and the wiring members 90, and it shows the print head 50 shown in FIG. 4 as viewed from above. As shown in FIG. 5, the piezoelectric elements 58 each have a substantially square planar shape which is approximately similar to that of the pressure chamber 52, and are positioned so as to be superimposed with the pressure chambers 52. Furthermore, an electrode pad 57*a* extending from the individual electrode 57 of the piezoelectric element 58 to the exterior of the piezoelectric element 58 is formed in a corner (the lower left-hand corner in FIG. 5) of each piezoelectric element 58, and each wiring member 90 is disposed so as to overlap with the electrode pad 57*a*.

Figure 6:
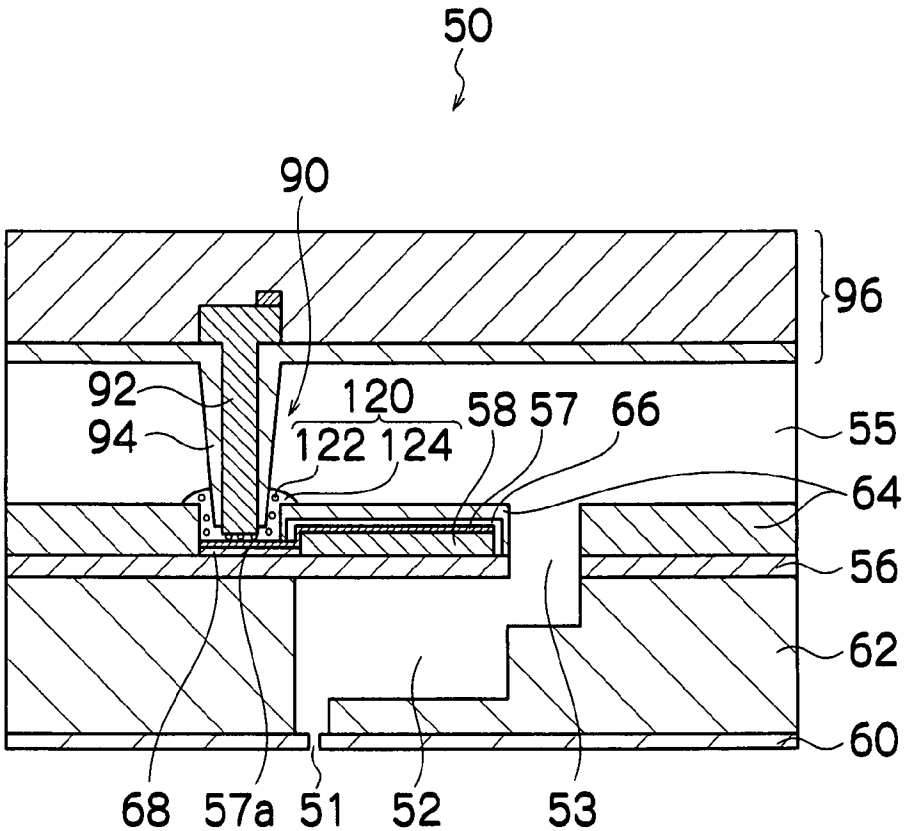
FIG. 6 is a cross-sectional diagram along line 6-6 in FIG. 5.

FIG. 6 is a cross-sectional diagram along line 6-6 in FIG. 5. As shown in FIG. 6, the print head 50 has a composition in which a nozzle plate 60 formed with the nozzle 51, a flow channel plate 62 formed with the pressure chamber 52, and the diaphragm 56, are arranged to overlap each other. Furthermore, the piezoelectric element 58 is arranged at a position corresponding to the pressure chamber 52, and a plate-shaped insulating cover 64 is arranged so as to cover the piezoelectric element 58 and the surface of the diaphragm 56. The insulating cover. 64 is arranged as a protective member for the piezoelectric element 58 and provides the piezoelectric element 58 with insulation from the ink accumulated in the common liquid chamber 55 formed above the piezoelectric element 58. The insulating cover 64 is not limited to being a plate shape, as in the present embodiment, and may also be formed by a film shape. In order to simplify the description, the respective plate members 60, 62, 56 and 64 constituting the print head 50 are depicted as each having a one-plate composition, but they may each be constituted by a plurality of plates. Furthermore, the print head 50 is not limited to one which has a laminated structure of the plate members 60, 62, 56 and 64, and it may also be made integrally from resin.

A through hole corresponding to the ink supply port 53 connecting the common liquid chamber 55 and the pressure chamber 52 is formed in the diaphragm 56 and the insulating cover 64. The ink accumulated in the common liquid chamber 55 is supplied to the pressure chamber 52 through the ink supply port 53.

The diaphragm 56 is constituted by a conductive member made of stainless steel, or the like, and the diaphragm 56 also serves as a common electrode of the piezoelectric elements 58. Therefore, an insulating layer 68 is provided between the diaphragm 56 and the electrode pad 57*a* extracted from the individual electrode 57 of the piezoelectric element 58 to the exterior of the piezoelectric element 58.

The wiring member 90 is provided on top of the electrode pad 57*a*, and is a structural body in which the side faces of the electrode 92 are covered with resin 94. As described with reference to FIG. 4, the wiring members 90 have a tapered shape which become thinner from the upper side to the lower side in FIG. 4, and are formed in such a manner that they rise upward inside the common liquid chamber 55 in a direction substantially perpendicular to the diaphragm 56. The electrode 92 is exposed at the front end section (lower side in FIG. 6) of each wiring member 90.

The wiring member 90 is bonded to the electrode pad 57*a* through adhesive 120. The adhesive 120 is constituted by a non-conductive resin 124 containing conductive particles 122, and an embodiment of the non-conductive resin 124 is epoxy adhesive. The epoxy adhesive has high chemical tolerance, and is suitable for bonding the regions wet by ink.

By bonding the wiring member 90 and the electrode pad 57*a* together by means of the adhesive 120, the electrode 92 of the wiring member 90 and the electrode pad 57*a* are electrically connected through the conductive particles 122 contained in the adhesive 120. Since the electrode pad 57*a* is formed integrally with the individual electrode 57, electrical connection between the electrode 92 in the wiring member 90 and the individual electrode 57 is ensured by this bonding structure. Furthermore, since the periphery of the bonding section between the wiring member 90 and the electrode pad 57*a* is covered with the non-conductive resin 124 as shown in FIG. 6, then it is possible to ensure insulation with respect to the ink, simultaneously with the aforementioned bonding structure.

In the present embodiment, desirably, the conductive particles 122 in the adhesive 120 have a degree of elasticity, and more desirably, the Young's modulus of the conductive particles 122 is lower than the Young's modulus of the wiring members 90. Moreover, even more desirably, the conductive particles 122 each have a structure in which the surface of an elastic body is coated with a metallic thin film. One embodiment of the conductive particle 122 having a structure in which the surface of an elastic body is coated with a metallic thin film is a particle in which Ni—Au fieldless plating is formed on a polystyrene sphere. If the conductive particles 122 are composed in this manner, then it is possible to absorb manufacturing variations in the wiring members 90, and the like, when the wiring members 90 are bonded with the electrode pads 57*a*. Furthermore, since the conductive particles 122 deform readily during the bonding step, then it is possible to prevent deformation or disconnection of the wiring members 90, and the like.

The wiring substrate 96 constituting the upper face of the common liquid chamber 55 is formed of resin integrally with the wiring members 90. A wiring pattern (not illustrated) is formed on the wiring substrate 96, and the electrodes 92 of the wiring members 90 are electrically connected to the respective wires formed in the wiring substrate 96.

The action of the print head 50 having this structure is now described. The ink accumulated in the common liquid chamber 55 is supplied to the respective pressure chambers 52, through the ink supply ports 53. A drive signal is supplied to the piezoelectric element 58 from the head driver 84 shown in FIG. 2, through the wiring substrate 96 and the wiring member 90, thereby causing the piezoelectric element 58 to deform. Consequently, the diaphragm 56 deforms and the ink filled in the pressure chamber 52 is pressurized and is ejected from the nozzle 51 in the form of an ink droplet. When the ink droplet has been ejected from the nozzle 51, new ink is supplied to the pressure chamber 52 from the common liquid chamber 55, through the ink supply port 53, and the next ink ejection operation is performed.

In the present embodiment, the common liquid chamber 55 is disposed on the opposite side of the pressure chambers 52 from the side where the nozzles 51 are formed, and the wiring members 90 having the electrodes 92 for driving the piezoelectric elements 58 are provided so as to rise up through the common liquid chamber 55 in a direction substantially perpendicular to the diaphragm 56. Thereby, it is possible to ensure sufficient space for arranging the drive wires which drive the piezoelectric elements 58, on the wiring substrate 96 which constitutes the upper face of the common liquid chamber 55. Furthermore, the flow channels linking the common liquid chamber 55 with the respective pressure chambers 52 do not have a complicated shape and therefore refilling performance is improved. Consequently, high-density arrangement of the nozzles 51 can be achieved and high-viscosity ink can be ejected.

Figure 7A:
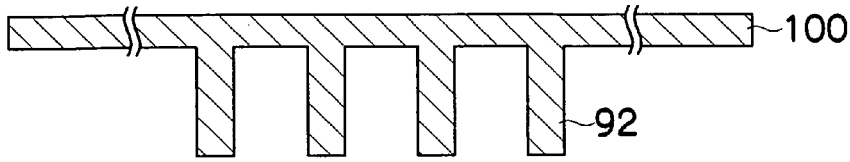
FIGS. 7A to 7F are illustrative diagrams showing steps of manufacturing a wiring substrate.

Next, a method of manufacturing the wiring substrate 96 which is formed of resin integrally with the wiring members 90 is described. FIGS. 7A to 7F are illustrative diagrams showing steps of manufacturing the wiring substrate 96. Firstly, as shown in FIG. 7A, a plurality of column-shaped conducting members (electrodes) 92 are formed extending in a direction substantially perpendicular to a single metal layer 100. The conducting members 92 are formed by using a commonly known electroforming method, and are made of nickel, for example. In this case, the conducting members 92 are electrically connected by means of the metal layer 100. Rather than electroforming, it is also possible to provisionally dispose conductive pins made of Cu, Ni, Al, Ag, or Au, or an alloy containing these, and the like, in an arrangement similar to that of the conducting members 92.

Figure 7B:
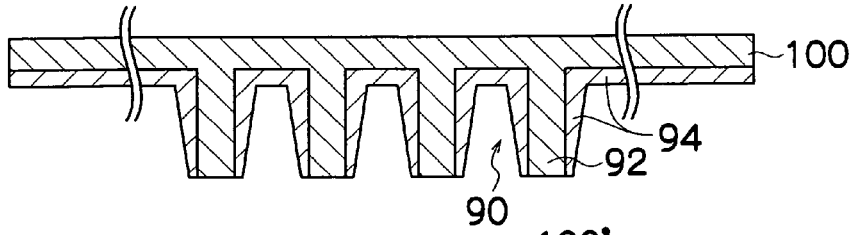

Next, as shown in FIG. 7B, a resin 94 having electrical insulating properties is molded onto the surface of the metal layer 100 on which the conducting members 92 have been formed, thereby covering the side faces of the conducting members 92 with the resin 94. The resin 94 is desirably a thermosetting resin, for example, an epoxy resin, a phenol resin, a polyimide resin, or a melanin resin, or the like. The structural bodies formed by the resin 94 covering the side faces of the conducting members 92 correspond to the wiring members 90 shown in FIG. 6.

Figure 7C:
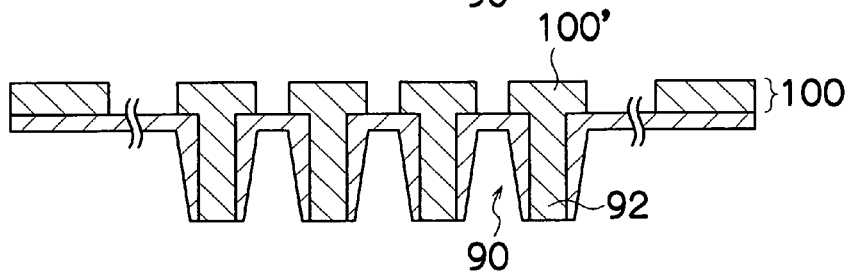

Next, a mask (not illustrated) is placed on the side of the metal layer 100 reverse to the side where the conducting members 92 are formed, and the metal layer 100 is processed by etching or laser in such a manner that the conducting members 92 are electrically separated, thereby forming individual metal layers 100' as shown in FIG. 7C. The mask is then removed. Thereby, the conducting members 92 become electrically separated from each other.

Figure 7D:
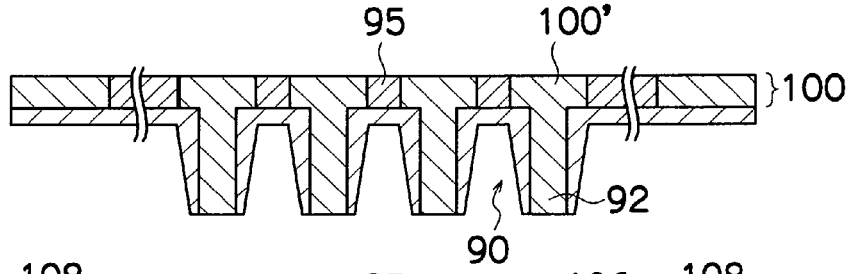

Next, as shown in FIG. 7D, resin 95 is introduced by screen printing into the gaps formed between the individual metal layers 100'. The resin 95 is formed to substantially the same height as the individual metal layers 100'. Furthermore, desirably, the resin 95 is made of the same material as the resin 94.

Figure 7E:
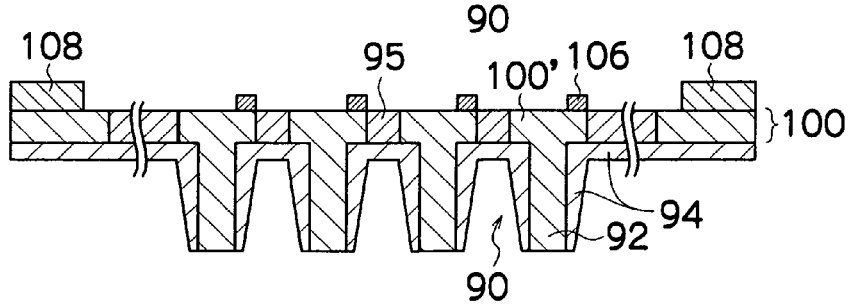

Next, as shown in FIG. 7E, individual wires 106 which respectively connect the individual metal layers 100' with a switching IC (integrated circuit) chip 108 are formed by plating, or the like. The composition of the connections between the individual metal layers 100' and the switching IC chip 108 is described later with reference to FIG. 8. The switching IC chip 108 may be installed on the metal layer 100 before forming the individual wires 106, or it may be installed after forming the individual wires 106. Desirably, an epoxy resin which is chemically stable and has high heat tolerance is used for installing the switching IC chip 108, since this is suitable for electrically connecting the switching IC chip 108 with the individual wires 106 thermally by solder reflow, ACF (anisotropic conductive film), or the like.

Figure 7F:
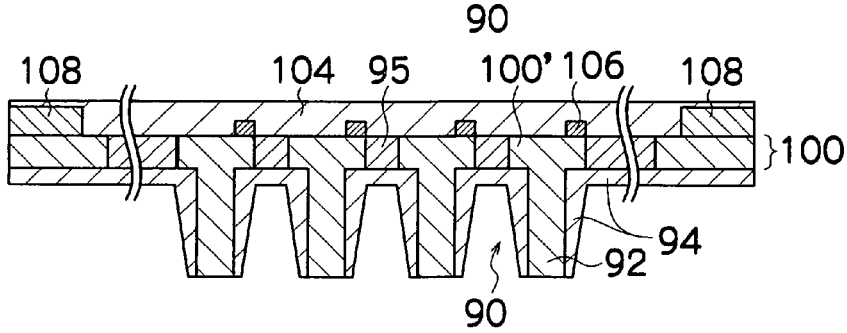

Next, as shown in FIG. 7F, resin 104 is molded to cover the individual metal films 100', the resin 95 and the individual wires 106, as well as the surface of the switching IC chip 108. Desirably, the resin 104 is made of the same material as the resin 94, as this brings advantages in that no stress acts on the members due to differences in linear expansion, as occurs when different resin materials are molded, and there is no bonding instability, such as insufficient bonding strength of adhesive, as occurs in cases where different materials are bonded together through the adhesive. Finally, a flexible cable 110 (not shown in FIG. 7F, but shown in FIG. 8) is connected to the switching IC chip 108.

Figure 8:
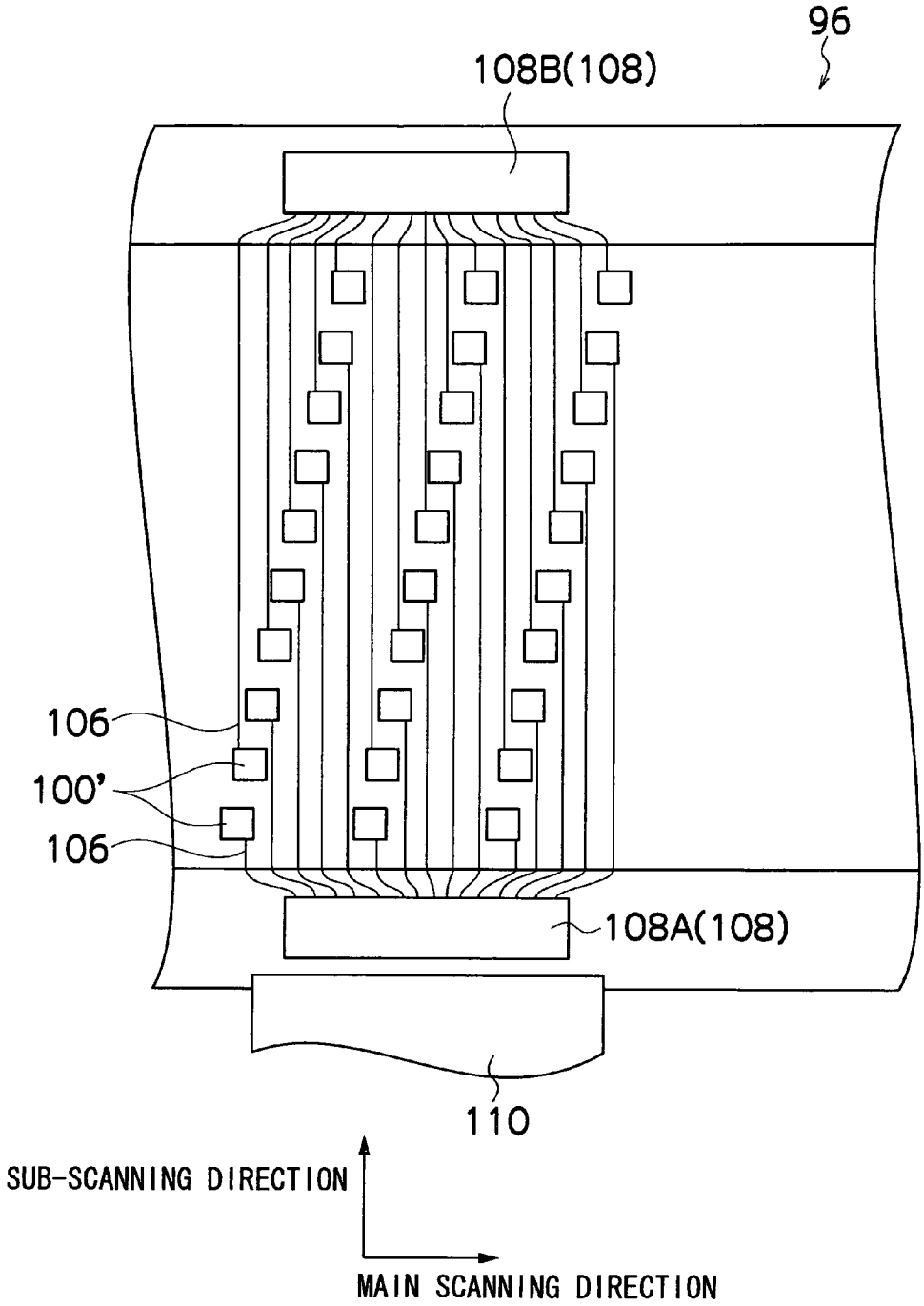
FIG. 8 is a plan view perspective diagram of a portion of a wiring substrate.

Next, the composition of the connections between the individual metal layers 100' and the switching IC chip 108 is described. FIG. 8 shows a plan view perspective diagram of a portion of the wiring substrate 96. In FIG. 8, the connections between the individual metal layers 100' and the switching IC chip 108 are depicted in a schematic view.

As shown in FIG. 8, the inner region of the wiring substrate 96, excluding the end sections in the sub-scanning direction, corresponds to the region where the pressure chamber units 54 shown in FIG. 3 are formed. The individual metal layers 100' are arranged in a matrix configuration, similarly to the pressure chamber units 54. The individual wires 106 which connect to one of the switching IC chips 108 (108A, 108B) provided at either end section of the wiring substrate 96 are provided respectively for the individual metal layers 100'. Each switching IC chip 108 is connected to the plurality of individual wires 106 and is also connected to the flexible cable 110. The flexible cable 110 is connected to the head driver 84 shown in FIG. 2. The individual metal layers 100', the individual wires 106 and the surfaces of the switching IC chips 108 are covered with the resin 104 (not shown in FIG. 8, but shown in FIG. 7F).

In this way, it is possible to manufacture the wiring substrate 96 which is composed integrally with the wiring members 90, from the resin. In this case, the plate members (60, 62, 56 and 64) composing the lower half of the print head 50 shown in FIG. 6 are previously manufactured by means of commonly known methods. The print head 50 can be manufactured by bonding the front end sections of the wiring members 90 (on the lower side in FIG. 6) with the electrode pads 57*a* of the individual electrodes 57 by means of the adhesive 120, as described with reference to FIG. 6.

In the present embodiment, since the electrodes (conducting members) 92 of the wiring members 90 and the switching IC chips 108 are composed integrally and are covered with the resin layers 94, 95 and 104, then there is a high degree of affinity between the wiring members 90 and the wiring substrate 96, and hence the structurally stable print head 50 can be obtained. Furthermore, the degree of integration in the print head 50 can be increased, and the size of the print head 50 can be further reduced.

Moreover, in the present embodiment, by molding the resin 94 having electrical insulating properties onto the side faces of the conducting members 92 formed on the metal layer 100, it is possible to ensure reliable insulation of a large number of conducting members 92, in a single operation. Consequently, it is possible to manufacture the wiring substrate 96 efficiently, and therefore, the productivity of the print head 50 is improved.

In the present embodiment, due to the use of the switching IC chips 108, the number of wires in the flexible cable 110 connected to the head driver 84 can be reduced compared to the number of individual wires 106 connected to the individual metal layers 100', and therefore, the reliability of the electrical connections in the print head 50 is improved.

The present embodiment shows the composition in which switching IC chips 108 are provided at either end section of the wiring substrate 96, but the composition is not limited to this, and it is also possible to arrange the switching IC chip 108 in the inner region of the wiring substrate 96. In this case, a merit is obtained in that the print head 50 can be reduced in size.

Second Embodiment

FIGS. 9A to 9E are illustrative diagrams showing steps for manufacturing the wiring substrate 96 which is composed integrally with the wiring members 90 according to a second embodiment of the present invention.

Figure 9A:
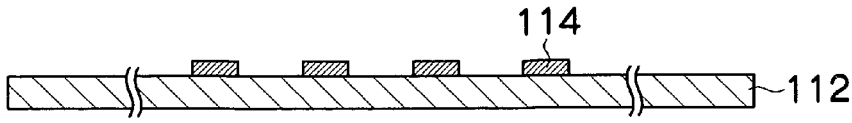
FIGS. 9A to 9E are illustrative diagrams showing steps of manufacturing a wiring substrate according to a second embodiment.

Firstly, as shown in FIG. 9A, a substrate 112 formed with a prescribed wiring pattern is prepared. Individual wires 114 corresponding to the individual wires 106 shown in FIGS. 7A to 7F are formed on the substrate 112, and the individual wires 114 are composed so as to provide electrical connections between the conducting members 92 and the switching IC chips 108 (described later).

Figure 9B:
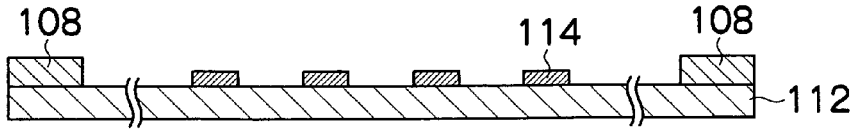

Next, as shown in FIG. 9B, the switching IC chips 108 are installed on the substrate 112 in prescribed positions. In the present embodiment, similarly to the first embodiment (see FIG. 8), the switching IC chips 108 are arranged in either end section of the substrate 112.

Figure 9C:
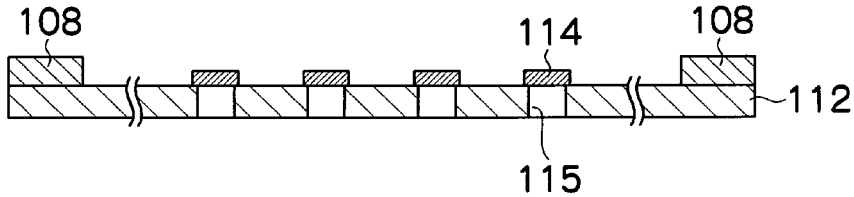

Next, as shown in FIG. 9C, hole sections (through holes) 115 corresponding to the individual wires 114 on the substrate 112 are processed by laser, or the like. Alternatively, it is also possible that a substrate 112 in which hole sections 115 have been formed is prepared, and the individual wires 114 are then formed on the hole sections 115.

Figure 9D:
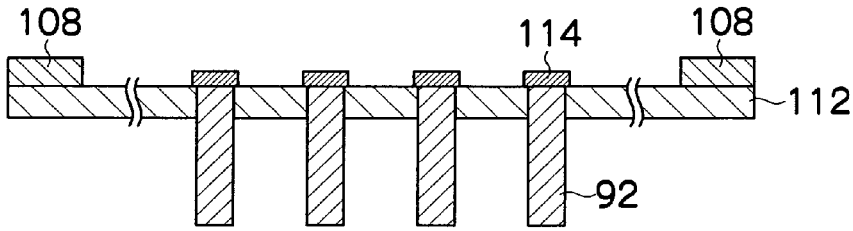

Next, a resist (not shown) is formed on the surface of the substrate 112 reverse to the surface on which the individual wires 114 are arranged, and column-shaped conducting members 92 extending in a direction substantially perpendicular to the substrate 112 are formed by a commonly known electroforming technique, as shown in FIG. 9D. The conducting members 92 are made of nickel, for example. After formation of the conducting members 92, the resist is removed by a developing process. The conducting members 92 may be formed by applying a photosensitive paste and then etching, or by developing a dry film and then applying a paste.

Figure 9E:
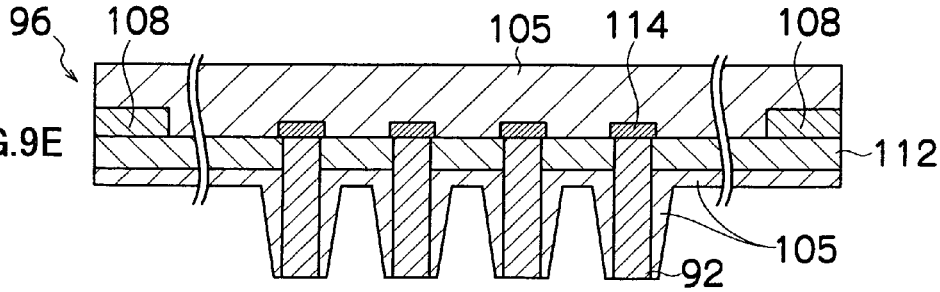

Finally, as shown in FIG. 9E, both surfaces of the substrate 112 are molded with resin 105, thereby covering the side faces of the conducting members 102 with the resin 105, as well as covering the surfaces of the individual wires 114 and the switching IC chips 108. The resin 105 is made of the same material as the resin layers 94 and 104 in the first embodiment. A flexible cable is connected to the switching IC chip 108. In this way, it is possible to manufacture the wiring substrate 96 having the integrated molded structure. The remainder of the composition is the same as that of the first embodiment, and hence further description thereof is omitted here.

In the second embodiment, as well as displaying similar beneficial effects to those of the first embodiment, the following beneficial effects are also obtained. More specifically, in the second embodiment, since the substrate 112 which has been previously formed with the prescribed wiring pattern is used, then at the stage of manufacturing the wiring substrate 96, there is no need to perform a step of processing the metal layer 100 in order to electrically separate the respective conducting members 92, as described in the first embodiment (see FIG. 6C). Consequently, it is possible to manufacture the wiring substrate 96 efficiently, and therefore, the productivity of the print head 50 is improved.

The liquid ejection head, image forming apparatus and method of manufacturing a liquid ejection head according to the present invention have been described in detail above, but the present invention is not limited to the aforementioned embodiments, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of ejection ports which eject liquid;

a plurality of pressure chambers which are respectively connected to the ejection ports;

a plurality of piezoelectric elements which respectively deform the pressure chambers, the piezoelectric elements being arranged on sides of the pressure chambers opposite to sides thereof where the ejection ports are formed;

a common liquid chamber which supplies the liquid to the pressure chambers, the common liquid chamber being arranged on the sides of the pressure chambers opposite to the sides thereof where the ejection ports are formed;

a plurality of wiring members which have electrodes for driving the piezoelectric elements, respectively, each of the wiring members being formed in such a manner that at least a portion thereof has a column-shape rising through the common liquid chamber in a direction substantially perpendicular to a plane on which the piezoelectric elements are arranged; and switching circuitry connected to each of the plurality of wiring members to selectively supply signals from an external print data source to the piezoelectric elements, the switching circuitry being arranged on a wall of the common liquid chamber opposite to a side thereof where the piezoelectric elements are arranged, wherein:

the electrodes are provided on a different side of the wall from the switching circuitry and the electrodes and the switching circuitry are covered integrally with resin;

the ejection ports are arranged in a two-dimensional array; and the wiring members are arranged two-dimensionally on the plane where the piezoelectric elements are arranged.

2. The liquid ejection head as defined in claim 1, wherein the wiring members are formed so as to rise from the piezoelectric elements.

3. The liquid ejection head as defined in claim 1, wherein the wiring members are formed so as to rise from vicinity of the piezoelectric elements.

4. An image forming apparatus, comprising the liquid ejection head as defined in claim 1.

5. The liquid ejection head as defined in claim 1, wherein the switching circuitry comprises two integrated switching circuits.

6. The liquid ejection head as defined in claim 1, wherein the at least a portion of the wiring members that rises through the common liquid chamber in a direction substantially perpendicular to a plane on which the piezoelectric elements are arranged has a further portion extending through the wall of the common liquid chamber opposite to the side thereof where the piezoelectric elements are arranged.

7. The liquid ejection head as defined in claim 6, wherein the switching circuitry comprises two integrated switching circuits that are connected to individual ones of different ones of the plurality of wiring members by individual wires on the wall of the common liquid chamber opposite to the side thereof where the piezoelectric elements are arranged.

* * * * *